United States Patent [19]

Kiplinger

[11] Patent Number: 5,027,952

[45] Date of Patent: Jul. 2, 1991

[54] PLASTIC BOTTLE FOR ACID DRAIN OPENING SYSTEM

[75] Inventor: Dale V. Kiplinger, Carrollton, Tex.

[73] Assignee: NCH Corporation, Irving, Tex.

[21] Appl. No.: 574,834

[22] Filed: Aug. 29, 1990

Related U.S. Application Data

[62] Division of Ser. No. 316,893, Feb. 28, 1989, Pat. No. 4,969,491.

[51] Int. Cl.[5] ..... B65D 85/84; B65D 1/02

[52] U.S. Cl. ..... 206/524.5; 215/31

[58] Field of Search ..... 206/524.5, 524.4; 215/31

[56] References Cited

U.S. PATENT DOCUMENTS

| | | | |
|---|---|---|---|
| 271,357 | 1/1883 | Pike . | |
| 2,283,780 | 5/1942 | Ahern . | |
| 2,300,319 | 10/1942 | Smith . | |
| 2,373,373 | 4/1945 | Berg . | |
| 2,435,033 | 1/1948 | Campbell . | |
| 2,711,645 | 6/1955 | Burchett et al. . | |
| 2,714,977 | 8/1955 | Davis . | |
| 2,862,531 | 12/1958 | Walker . | |
| 3,079,954 | 3/1963 | Knapp . | |
| 3,092,106 | 6/1963 | Butler . | |
| 3,823,427 | 7/1974 | Pittet . | |
| 3,937,404 | 2/1976 | Johnson . | |
| 4,034,427 | 7/1977 | Breznock et al. . | |
| 4,426,003 | 1/1984 | Zarov | 206/524.5 |
| 4,457,877 | 7/1984 | Love et al. . | |
| 4,600,125 | 7/1986 | Maynard, Jr. . | |
| 4,884,708 | 12/1989 | Lange et al. | 206/524.5 |

*Primary Examiner*—William I. Price

*Attorney, Agent, or Firm*—Caesar, Rivise, Bernstein, Cohen & Pokotilow, Ltd.

[57] ABSTRACT

A system for administering acid to a clogged drain, and the method of using the system. The system includes a coupling to which a container of the acid can be threadedly secured. The coupling includes a piercing nipple, which penetrates a seal on the acid bottle. The nipple is hollow, and the acid passes from the bottle through the nipple and into a rigid, but arcuately deformable, tube that is connected to the coupling and is in fluid communication with the nipple. The tube is inserted into the clogged drain, until it is embedded in the clog. The acid is delivered directly to the clog, where it reacts with and dissolves the same.

4 Claims, 3 Drawing Sheets

FIG. 1
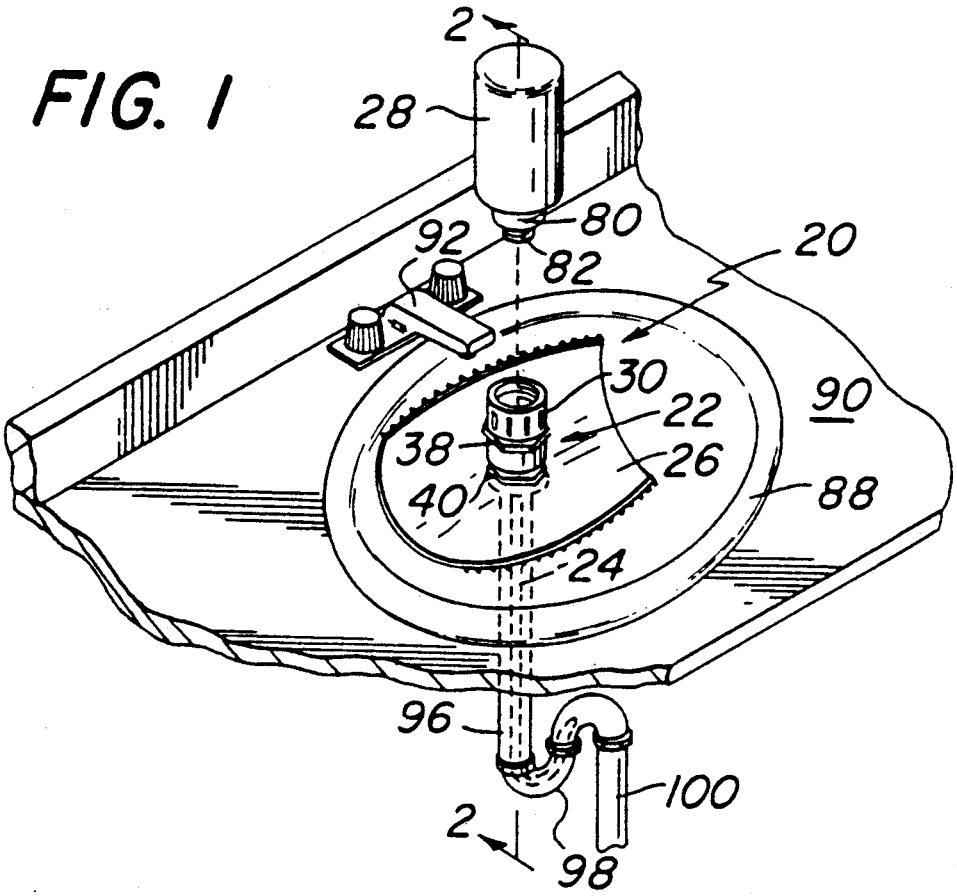
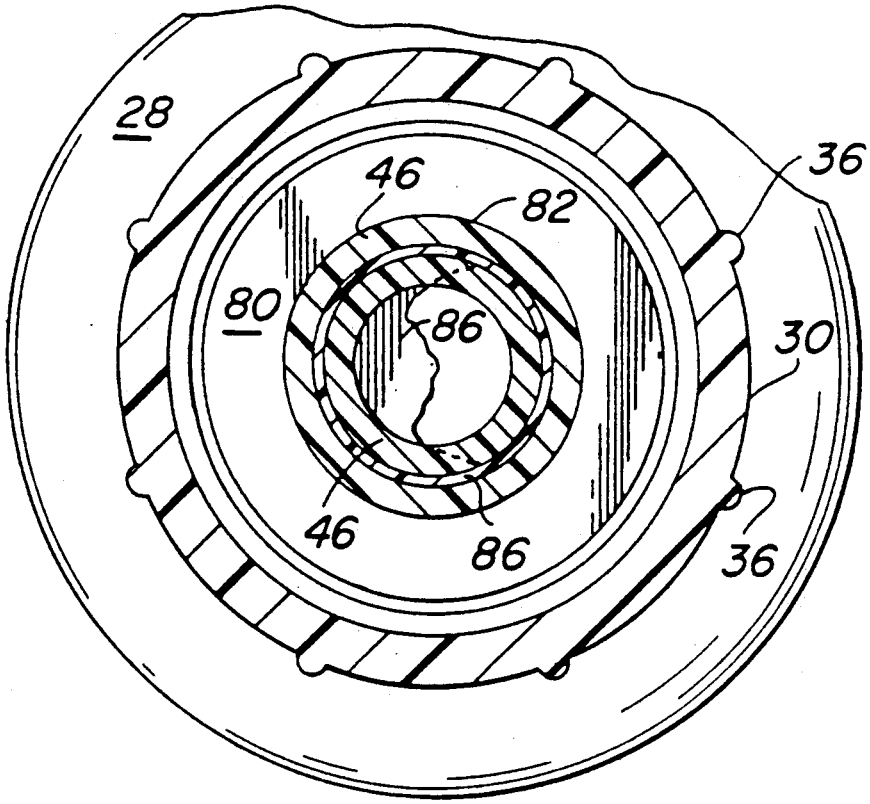
FIG. 4

PLASTIC BOTTLE FOR ACID DRAIN OPENING SYSTEM

This is a division of application Ser. No. 07/316,893, filed Feb. 28, 1989 and now U.S. Pat. No. 4,969,491.

BACKGROUND OF THE INVENTION

This invention relates to an acid drain opening system, in general, and, more particularly, to a system for administering acid to a clogged drain and the method of use of the system.

During normal use, drains tend to become clogged with various materials that are rinsed down the drain, such as oils, hair, toilet paper, talcum powder and petroleum jelly. The materials that clog the drain settle in the trap, and until they are removed or broken up, water will not pass through the drain.

Various devices and chemical compositions have been developed for clearing the drain. Some of these are mechanical in nature, such as a plunger, which consists of a rigid suction cup on a stick, or a plumber's snake or drain auger, which is a mechanical device rotated in the trap, in an attempt to break up the clog.

In recent years, pressurized cans have been developed, which break up the clogs through the use of released gas pressure. Devices of this type are shown in U.S. Pat. Nos. 3,823,427 (Pittet) and 4,034,427 (Breznock et al.).

Various alkali chemical cleaners are also used for clearing clogged drains. These chemical cleaners are available in both liquid and granular form. The liquid chemical cleaners can be poured through standing water in a sink, whereas the standing water should be drained before using the granular cleaners. The chemical cleaners cause a chemical reaction at the clog and many of them create substantial heat. The net result is that the clog is loosened sufficiently to permit it to be removed by cold running water, after the reaction has been completed.

If none of the foregoing devices and compositions work to remove the clog, a homeowner will normally call a plumber. One of the most common methods used by a plumber, and possibly by homeowners, to remove a clog, when all else has failed, is to pour concentrated sulfuric acid into the drain. If water remains in the drain, the acid, which has a higher specific gravity than water, will settle through the water, until it reaches the clog. At that point, the acid will react with the clog, and eat away at the clog, until the clog is destroyed. The drain can then be flushed with cold water.

One of the problems with using the acid is that it is extremely dangerous. A substantial amount of heat is created by the reaction of the acid with the material forming the clog, and on many occasions, this will cause the acid to blow back out of the drain and onto the person who administered the acid. Needless to say, serious injury to the skin or eyes can result from the use of sulfuric acid to clear a clog, even though sulfuric acid has been found to be extremely effective in breaking up the clog.

The device and method of this invention provide a safe and effective means of injecting sulfuric acid into a clog, while minimizing the danger to the person administering the acid.

The device of this invention includes a sealed bottle of sulfuric acid, with a means for piercing the seal, without the user of the acid having his skin come in contact with the acid. After the seal is pierced, the acid flows through a tube, which has an open end within the clog. Devices for removing liquid from a sealed container, and administering the liquid through a tube, are well known to the art. Generally, devices of this type have been used for removing oil from a sealed can, and pouring the oil, through a tube, into an engine. An example of such an oil-pouring device can be found in U.S. Pat. No. 4,600,125 (Maynard, Jr.).

The device of this invention is specifically different from that shown in Maynard. The device is secured to the acid bottle, and this prevents the inadvertent removal of the bottle from the pouring device. In Maynard, there is merely a piercing spout which pierces the top of a metal can. Additionally, the tube on this device is relatively rigid, so that it can be inserted down the drain and into the clog. In the Maynard device, the tube is flexible, and has a bellows construction. Although that construction is effective for pouring oil into a crankcase, it would not be effective for insertion into and through a clog. To the contrary, when the clog is contacted, the bellows would merely collapse.

Another advantage of the device of this invention over that of Maynard is that the acid leaving the bottle can only pass through the tube, and cannot come in contact with the person administering the acid. By way of contrast, in Maynard, after the oil can is pierced, the oil enters a funnel, and passes through a screen, before entering the spout. If the Maynard device were used for acid, if there were any blowback through the tube, it could blow the can away from the funnel, thereby blowing acid on the person administering the acid.

Since the device of this invention requires the draining of acid from a bottle that is closed, except for the top opening, in order to prevent creating a vacuum within the bottle as the acid is withdrawn, air holes are provided in the device to periodically admit air into the acid bottle. This prevents the creation of a vacuum, which could prevent or severely hinder the pouring of the acid. Vent holes of this type are known in the prior art, as shown in U.S. Pat. Nos. 2,435,033 (Campbell) and 2,714,977 (Davis). However, neither of the devices shown in these prior patents is used for pouring acid into a clog. In the former patent, the vent holes are used in connection with transferring various non-corrosive liquids, and in the latter patent, they are used in connection with dispensing oil into a crankcase.

OBJECTS OF THE INVENTION

Accordingly, it is a general object of this invention to provide a novel system for injecting acid into a drain clog.

It is another object of this invention to provide a safe and effective means for removing liquids from a container and injecting them into a remote location.

It is a further object of this invention to provide a novel bottle.

It is yet a further object of this invention to provide a novel method of injecting acid into a drain clog.

SUMMARY OF THE INVENTION

These and other objects of the invention are accomplished by providing a coupling having an open top and closed bottom. An opening is formed within the bottom, and a hollow piercing means is secured in and projects upwardly from the opening. A rigid, but slightly deformable, hollow tube is connected to and is in fluid communication with the piercing means, and projects downwardly from the bottom of the coupling. The coupling contains securing means for securing a container of liquid thereto. When the container of liquid is secured to the coupling, a portion of the container projects into the coupling, and a seal on that portion is pierced by the piercing means, to enable the liquid within the container to flow through the piercing means, through the tube and into a remote area in which the tube has been inserted.

The invention further encompasses a method of injecting acid into a drain clog comprising providing a coupling, said coupling having a piercing member mounted in an opening at the bottom thereof, said piercing member comprising a hollow tube, providing a rigid tube in fluid communication with said piercing tube, inserting the hollow tube into a drain until it is embedded in the clog, placing a portion of a sealed container of acid into said coupling in such a manner as to permit the piercing tube to pierce the container, whereby the acid from the container enters the piercing tube, passes through the hollow tube and into the clog, thereby reacting with and breaking up the clog.

DESCRIPTION OF THE DRAWINGS

Other objects and many of the attendant advantages of this invention will become readily appreciated as the same becomes better understood by reference to the following detailed description when considered in connection with the accompanying drawings, wherein:

FIG. 1 is a perspective view, partially broken away and partially exploded, showing the device of this invention placed in a sink and having its tube inserted in a clogged drain, with a bottle of acid positioned above the device;

FIG. 4 is a sectional view taken along the line 4—4 of FIG. 3;

DETAILED DESCRIPTION OF THE PREFERRED EMBODIMENT

Figure 2:
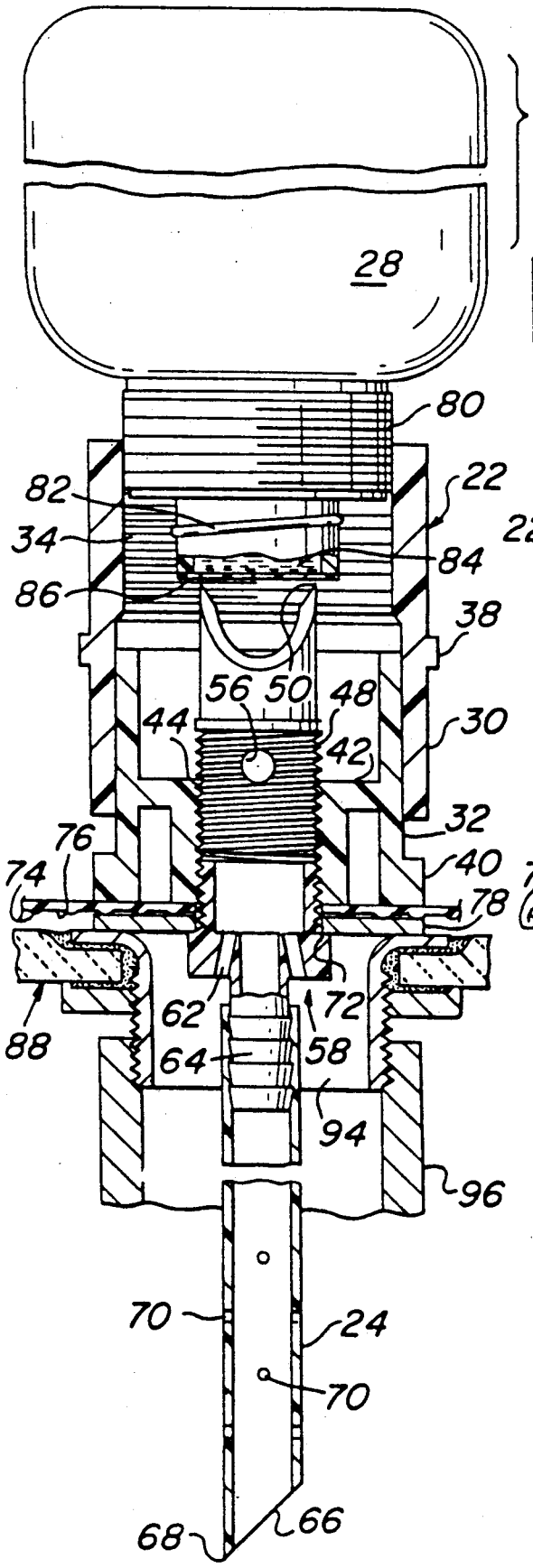
FIG. 2 is an enlarged sectional view taken along the line 2—2 of FIG. 1.

Referring now in greater detail to the various figures of the drawing, wherein like reference characters refer to like parts, an acid drain opening system embodying the present invention is generally shown at 20 in FIG. 1. Device 20 comprises a coupling 22 and a tube 24 in fluid communication with the coupling 22 and projecting downwardly therefrom. A rubber mat 26 is positioned between the coupling 22 and the tube 24. A bottle 28 containing concentrated sulfuric acid is used in conjunction with the device 20.

Figure 3:
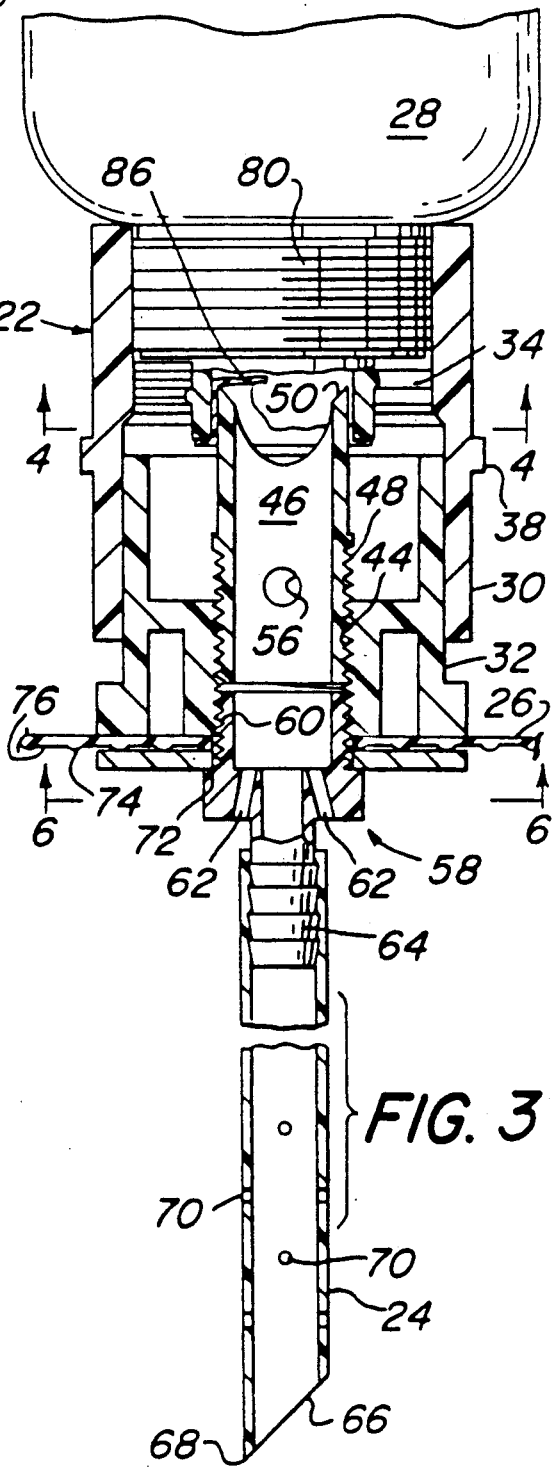
FIG. 3 is a sectional view, similar to FIG. 2, but showing the bottle of acid secured within the device of this invention.

Referring to FIGS. 2 and 3, it is seen that the coupling 22 comprises a cylindrical sleeve 30, having one end closed by cylindrical insert 32. Sleeve 30 is open at its top, as viewed in FIG. 1, and its upper end is internally threaded, as shown at 34 in FIGS. 2 and 3. Vertically extending ribs 36 are equally spaced around the outer surface of sleeve 30. An octagonal rim 38, having eight equally-sized flattened faces, projects around sleeve 30, perpendicularly to the ribs 36 (see FIG. 1).

Insert 32 is maintained within sleeve 30 by a frictional fit. In order to enable the assembly of the insert 32 in the sleeve 30, insert 32 is also provided with an octagonal rim 40, similar to rim 38 on sleeve 30 (FIG. 1). In assembling the coupling 30, the top of insert 32 is inserted in the bottom of sleeve 30, and can be moved upward within the sleeve by rotating the insert. In order to facilitate the movement of the insert within the sleeve, open-end wrenches can be applied to the flattened faces of rims 38 and 40, and the insert can then be rotated relative to the sleeve. Sleeve 30 and insert 32 can be molded from any durable, sulfuric acid-resistant plastic, such as polyethylene, polyvinyl chloride, etc.

Insert 32 includes a base 42. A central opening is formed in base 42, and is in fluid communication with an internally threaded bore 44. A nipple 46 (FIG. 5) is threadedly secured in the upper portion of bore 44, through the use of external threads 48.

Figure 5:
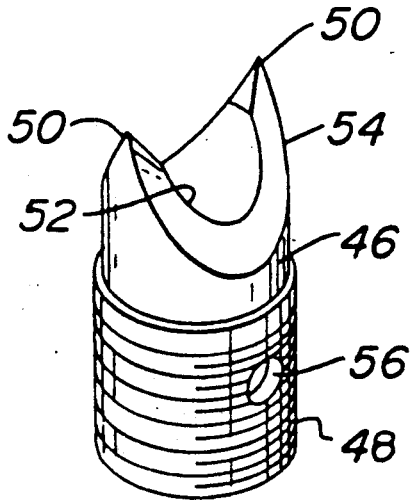
FIG. 5 is a perspective view of the piercing tube of the device of this invention; and, FIG. 6 is a sectional view taken along the line 6—6 of FIG. 3.

As seen in FIGS. 3 and 5, nipple 46 is formed from a hollow tube, and has two diametrically opposed piercing points 50 at the top thereof. The top of the wall forming the tube is formed with a concave cut, projecting downwardly from the points 50, and the wall is beveled, to leave upper and lower cutting edges 52 and 54, respectively. A pair of diametrically opposed holes 56 are formed through the threaded portion 48 of the nipple 46. The nipple can be formed from polypropylene.

Figure 6:
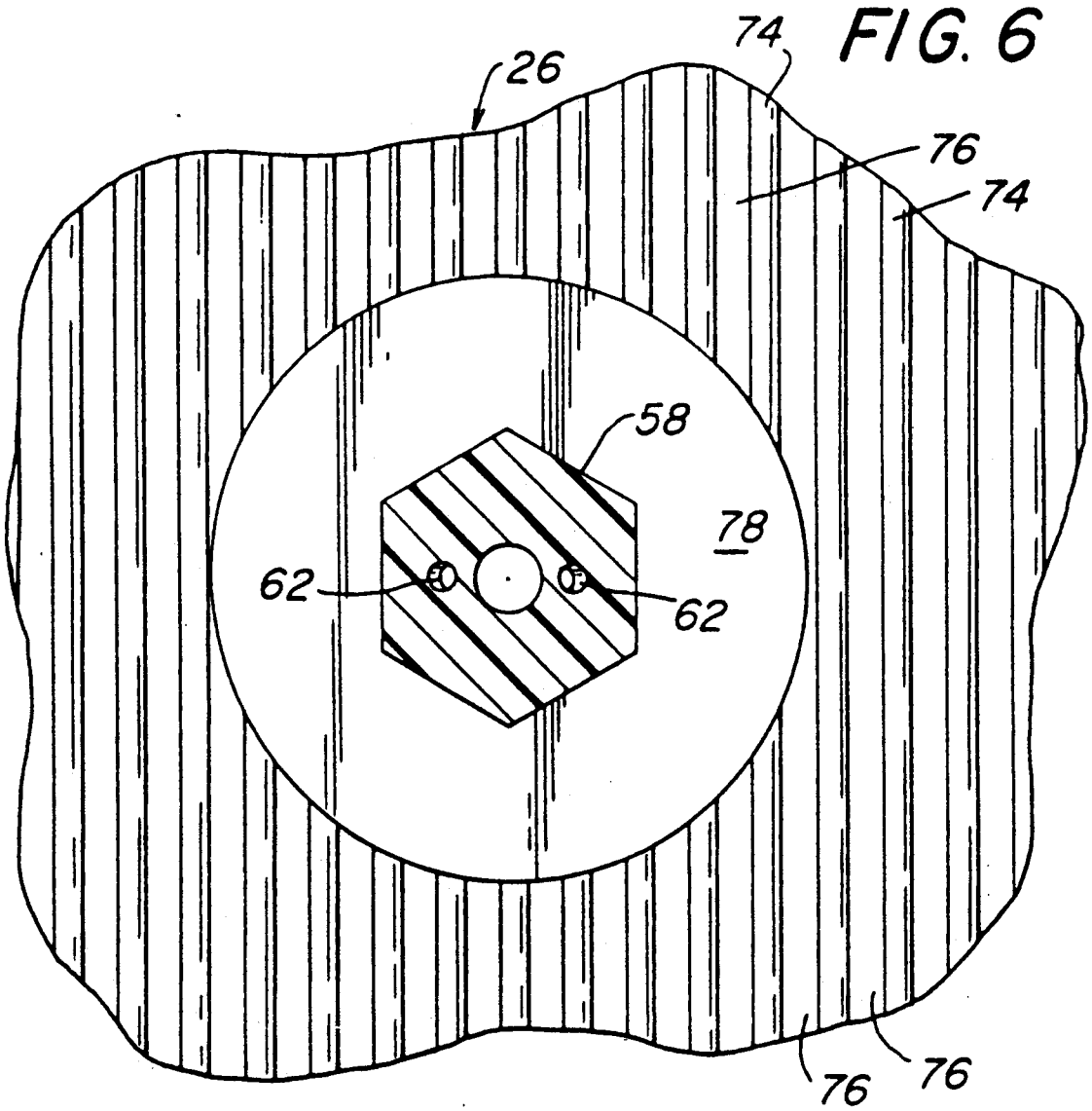

Positioned beneath nipple 46 is a connector 58 (FIGS. 2 and 3). Connector 58 has a hollow interior, and external threads 60, which are threadedly secured in bore 44. As seen in FIG. 6, connector 58 has a hexagonal cross section. The connector 58 can be secured in bore 44 by grasping two of the flattened faces of the connector with an open end wrench, and by grasping one of the octagonal rim 40 with an open end wrench, and threadedly advancing the connector within the bore. Two openings 62 are formed in the base of connector 58. These openings place the interior of the connector in fluid communication with the surrounding atmosphere.

The bottom of connector 58 includes a barbed extension 64. Tube 24 is slid over the barbs, and is retained in place by the upper edges of the barbs. As seen in FIGS. 2 and 3, extension 64 is hollow, and is in fluid communication with the interior of connector 58. The lower end of tube 24 has an angled face 66, which terminates in a pointed end 68. A plurality of openings 70 are formed in the lower portion of tube 24.

Tube 24 is basically rigid, but is slightly bendable into an arcuate shape. The rigidity is sufficient to prevent the tube's being collapsed or deformed by applying pressure to the sides of the tube. The tube is non-collapsible longitudinally, and has only a limited amount of arcuate bend available. Various plastic materials can be used for forming the tube, such as polyethylene. A polyethylene tube having an outer diameter of ½ inch (1.27 cm) and an internal diameter of ⅜ inch (0.95 cm) has been found to have sufficient rigidity, and sufficient arcuate deformability, to function in carrying out this invention. The connector 58 can be formed from any of the plastics usable in the other parts of the coupling 22. The connector can also be formed from polypropylene.

Positioned between the bottom of insert 32 and ledge 72 (FIGS. 2 and 3) of connector 58 is mat 26. Mat 26 is formed from a flexible material, such as natural or synthetic rubber, and includes longitudinally extending ribs 74 along its lower surface. The ribs are equally spaced, and between the ribs are channels 76.

The rubber mat has a central opening, and the connector 58 passes therethrough. Positioned on ledge 72 of the connector is a washer 78. Washer 78 is formed from a material that will not be corroded by sulfuric acid, such as stainless steel. The purpose of the washer is to maintain the rubber mat 26 in a horizontal position in the area of the coupling 22.

The bottle 28 is molded from polyethylene or other plastic which will not react with sulfuric acid. The bottle has a large, threaded neck portion 80 and a smaller threaded neck portion 82. After the bottle is filled with sulfuric acid, schematically shown at 84 in FIG. 2, a plastic seal 86 (FIG. 2) is placed over the mouth of the bottle. The plastic seal can be formed from any acid-resistant material. A preferred material is polyethylene, which can be heat-sealed in place. After the heat seal is placed on the acid, a rigid plastic cap is secured on threaded neck portion 84. The cap protects the seal and prevents inadvertent removal of the acid from the bottle. When it is intended to remove the acid from the bottle, the cap is removed.

The system of this invention is adapted to remove a clog from all types of drains, such as drains in sinks, showers and toilets. By way of example, the system is shown as being used on a sink, in FIG. 1. As seen in FIG. 1, the sink includes a bowl 88, a countertop 90 and a faucet 92. As seen in FIG. 2, bowl 88 includes a central opening with a drain collar 94 mounted therein. A drainpipe 96 (FIGS. 1 and 2) is threadedly secured on collar 94. A trap 98 (FIG. 1) is mounted on the bottom of drainpipe 96, and a pipe 100 is shown for carrying away the waste water after it passes through the trap.

The system of this invention can be used on virtually any type of clog that would normally develop in a drain. If there is any standing water remaining in the fixture requiring draining, the standing water should first be removed to a point below the surface of the fixture, for instance, below the top surface of the collar 94 in FIG. 2. This can easily be accomplished by using a cup and a bucket to hold the removed water. A sponge can be used to lower the water level below the top surface of the collar.

After the surface water has been removed, the tube 24 is inserted through the collar 94 and down drainpipe 96. When the tube encounters the clog, normally, by rotation of the coupling 22 and applying downward pressure, the tube will pass through the clog to a point on the unclogged side of trap 98. However, if the clog is too dense for the tube to pass totally through it, the system of this invention will still operate, with the tip 68 of the tube embedded in the clog. The insertion of the tube into, and possibly through, the clog is facilitated by the fact that the tube is rigid, from a cross-sectional and longitudinal standpoint. Thus, it cannot be collapsed in either dimension. The tube is sufficiently bendable to form an arc in passing through the clog, as shown in FIG. 1. The pointed end 68 and angled face 66 facilitate the insertion of the tube into and through the clog.

With the tube 24 fully inserted into and through the clog, as shown in FIG. 1, the mat 26 will contact the surface of the bowl 88, with the ribs 74 and channels 76 being lowermost. Depending on the size of the drain opening, the washer 78 will either totally cover the opening in collar 94 or will be positioned in the center of the collar. The washer 78 will not go into the drain opening, since this would be prevented by the contact of the mat 26 with the bowl.

At this point, acid can be administered to the clog. In order to do this, the cap is first removed from bottle 28, thereby exposing the seal 86 at the top of the bottle. The bottle is then inverted, as shown in FIG. 1, and threaded neck portion 80 is aligned with the threads 34 in sleeve 30, as shown in FIG. 2. At this point, the seal 86 is spaced above the points 50 of nipple 46. The bottle 28 is then rotated in a clockwise direction, thereby moving it downwardly relative to the points 50. Eventually, the points 50 will contact the seal 86, and pierce the seal. Continued rotation of the bottle in a clockwise direction will cause the seal to rupture, and the beveled edges 52 and 54 (FIG. 5) of the nipple will partially sever the seal from the mouth of the bottle. It should be noted, however, that there is not total severance, and part of the seal will remain in place, heat-sealed to the lip of the bottle. This condition is shown in FIGS. 3 and 4. The net effect of the rotational movement of the bottle relative to the nipple is that the seal is broken, partially severed and pushed out of the way. The seal is not totally removed from the bottle, and accordingly, will not clog the tube 24.

After the seal is punctured and partially severed, to the position shown in FIGS. 3 and 4, acid will leave bottle 28, and pass through nipple 46. The shredded seal 86 should act as a gasket, to prevent any of the acid from leaking from the bottle to the exterior of nipple 46. However, if it does, the acid will hit the base 42 of insert 32, and pass into the interior of nipple 46 through openings 56. The acid proceeds downwardly from nipple 46 through connector 58, and into tube 24. The acid then exits from the tube through the angled face 66 at the end of the tube and through opening 70 in the tube.

Assuming the tube has been pushed through the clog, the acid exiting from the angled face will drain back into the clog, reacting with the clog at the far end, that is, the end away from the drain. Additionally, acid will leave the tube through openings 70, and react with the clog along the entire length of the clog. Within about five to ten minutes, the reaction between the acid and the clog will be complete. At this point, the bottle 28 is unthreaded from the coupling 22, and water can then be poured into coupling 22, to flush the remaining acid from the trap. The fresh water can be poured directly into the nipple 46, or if any is poured onto the base 42 of insert 32, it will pass through openings 56, and downwardly through tube 24. After all of the acid has been flushed from the trap, the tube 24 is removed from the drain. However, so long as the tube is in place when the initial flushing water is added, if there is any blowback up the drainpipe, it will be contained by washer 78 and mat 26.

One of the features of this invention is the fact that any blowback caused by the reaction of the acid with the clog can be contained, without its reaching the skin or eyes of the plumber. Thus, when the acid is added to the clog, there is a chemical reaction between the acid and clog, and this generates a substantial amount of heat. There is still water remaining in the drainpipe at the time the acid is added. If the reaction is too violent, as has occurred when plumbers pour the acid directly through the standing water in the drainpipe, the water-acid mixture is literally blown back through the drain. If it contacts the skin or eyes of the plumber or homeowner administering the acid, serious injury can result.

Utilizing the device of this invention, if the reaction does cause a blowback, the material coming back through the drain will first contact washer 78. The material would then spread laterally, but would be confined by the rubber mat 26, which has sufficient weight, even though it is flexible, to remain in contact with the surface of the bowl. The liquid emanating from the drain then passes along the undersurface of the mat, in channels 76 between ribs 74. By the time the blown-back liquid reaches the edge of the mat, it will have lost its explosive force, and will simply remain on the surface of the bowl. The mat gives the person administering the acid sufficient protection to avoid any danger from blown-back acid. Although the exact size of the mat is a matter of choice, it is believed that a mat that is a 1 foot (30.5 cm) square should be adequate to withstand virtually any blowback.

One of the features of this invention is the provision of openings 62 in connector 58. Without these openings, as the acid is drained from the bottle 28, a vacuum will form in the space between the top of the acid level and the bottom of the bottle, which would be uppermost when the bottle is in its operational position shown in FIGS. 2 and 3. The existence of the vacuum can eventually prevent the acid from leaving the bottle, and can, in fact, create a vacuum in the bottle that can draw water into the bottle, causing a violent reaction, and possible rupture of the bottle.

The openings 62 are sufficiently small to prevent the acid from passing therethrough, while at the same time, are sufficiently large to permit the passage of air to neutralize the vacuum created above the acid as it is drained. Thus, the surface tension of the acid will prevent leakage through the openings. However, as the acid is drained, and the amount of vacuum becomes greater, air, under atmospheric pressure, will find its way through the openings to provide neutralization of the vacuum above the acid. Once the vacuum has been neutralized, acid will continue to flow, until the vacuum is sufficiently great to permit more air to pass through openings 62. The air for openings 62 is provided by withdrawing sufficient standing water from the bowl so that it is below the level of the bottom of connector 58. If more air is needed within that space, the coupling 22 can be rocked slightly, to provide more air.

The size of the openings 62 is somewhat critical. Thus, if the openings are too small in diameter, the vacuum within the acid bottle can actually draw water back into the bottle, causing the reaction and dangerous situations previously described. If the openings are too large in diameter, the acid will leave the bottle too quickly. This in turn will cause the clog to react with the acid too quickly, and generate too much heat, which could lead to a dangerous blowback. Although the optimum diameters of the openings 62 can be determined through experimentation, in the embodiment shown, utilizing a bottle containing 1 pint (47.3 cl) of acid, it has been found that having two openings which are 3/32 inch (0.24 cm) in diameter provides optimum results. Using openings of this diameter will permit the acid to drain in one to one and one-half minutes, and this will result in effective dissolution of the clog within five to ten minutes, without a dangerous blowback.

The theory of utilizing openings such as openings 62 to control liquid flow where a vacuum is being formed is described in greater detail in aforementioned U.S. Pat. No. 2,435,033 (Campbell). Campbell discloses the use of such openings for dispensing or transferring liquids in various environments, none of which is the same as the environment in which the instant invention is used. However, the theory on which the patented invention is based is the same theory that applies to this aspect of the instant invention.

Having the threaded connection between bottle 28 and coupling 22 provides many advantages. The removal of the seal 86 from the bottle opening is controlled by the rotation of the bottle in the threads. If the bottle were merely pushed downwardly, the seal might be severed totally, and could partially clog the tube 24. Additionally, by having the threaded connection between the bottle and the coupling, leakage is prevented. In the prior art devices where a can containing oil or other liquid is punctured by a piercing spout, leakage could occur. Having the threaded connection prevents leakage, which leakage could be dangerous when using acid.

Another safety feature of having the bottle threadedly connected to the coupling is that in the event of a sudden blowback, if the blowback should be partially through the tube 24, the bottle 28 will not be blown off. If there were nothing securing the bottle in place, such as the threads, the bottle could be easily dislodged, as could occur when the only connection is by puncturing the bottle with a spout.

Although this invention has been developed specifically for use with acid to remove a drain clog, the invention can be used with other chemical solutions that are normally used for opening drain clogs, and which may cause a violent reaction with or at the clog. Thus, the invention can be used with potassium hydroxide solutions, sodium hydroxide solutions or solvent-based solutions, for removing the clogs.

Without further elaboration, the foregoing will so fully illustrate this invention that others may, by applying current or future knowledge, readily adapt the same for use under various conditions of service.

I claim:

1. A molded plastic bottle and a removable cap therefor, said bottle being adapted to contain and dispense liquid into a liquid transferring device, said bottle having two necks, with one of said necks being of a diameter smaller than the other of said necks and forming a mouth for said bottle, said mouth being sealed by a barrier wall, each of said necks being externally threaded, with the larger of said necks being adapted to be threadedly secured to said liquid transferring device and the smaller of said necks adapted to be threadedly secured to said removable cap.

2. The bottle of claim 1, and further including acid within said bottle, said acid being adapted to remove clogs from a drain.

3. The bottle of claim 2 wherein said acid is sulfuric acid.

4. The bottle of claim 1 wherein said barrier wall is formed of plastic.

* * * * *